United States Patent [19]

Farnworth

[11] Patent Number: 4,937,950

[45] Date of Patent: Jul. 3, 1990

[54] SPACING AND HOLDING DEVICE FOR HORIZONTAL SIDING

[76] Inventor: Wilfred Farnworth, P.O. Box 278, Clinton, Wash. 98236

[21] Appl. No.: 380,281

[22] Filed: Jul. 17, 1989

[51] Int. Cl.[5] ..... G01B 5/14

[52] U.S. Cl. ..... 33/646; 33/647

[58] Field of Search ..... 33/646, 647, 648, 649, 33/370, 371; 269/904

[56] References Cited

U.S. PATENT DOCUMENTS

| | | | |
|---|---|---|---|
| 378,548 | 2/1888 | Hotchkiss | 33/646 |
| 421,746 | 2/1890 | Mooney | 33/646 |
| 723,746 | 3/1903 | Sivertson | 33/649 |
| 2,154,625 | 4/1939 | Kleineschay | 33/370 |
| 3,463,480 | 11/1966 | Edstrom | 33/646 |
| 4,782,597 | 11/1988 | Mills | 33/370 |

*Primary Examiner*—William A. Cuchlinski, Jr.
*Assistant Examiner*—Alvin Wirthlin

[57] ABSTRACT

A tool to facilitate the installation of horizontal siding boards comprising an upstanding shorter member provided with a flange projecting inwardly at its lower end and an upstanding longer member provided with an outwardly right-angled projection at its upper end, the two members being constrained to slide relative to each other longitudinally and held together by a nut-and-bolt type fastener passing through a hole in the shorter member and a slot in the longer member. The bolt is bored on its longitudinal axis to slidably accept a pin whose diameter is substantially the same as that of the nails used in the installation of siding boards. A bush of resilient material and inside diameter slightly less than the pin diameter is secured relative to the bolt on a longitudinal axis common to both. The pin is longer than the fastener in which it is retained by the compression effect of the resilient bush. In use, the two members are adjusted to give the required spacing and locked by tightening the nut. The lower flange is pressed upwardly against the lower edge of the last installed board and the pin is driven inwardly to secure the tool to the building. The next board may now be rested with its lower edge on the upper flange and nailed in place. The tool is removed by exerting a force outwardly from the building and the hole left by the pin is filled by a siding nail.

2 Claims, 1 Drawing Sheet

SPACING AND HOLDING DEVICE FOR HORIZONTAL SIDING

BACKGROUND OF THE INVENTION

This invention relates to a tool for use in the installation of horizontal siding boards. Each siding board has a lower edge which overlaps the upper portion of the previously installed board by a predetermined amount to ensure protection of the main structure from the weather. This overlap is important but the need for uniformity in the exposed portion of the board is also important. Provided there is sufficient overlap, board spacing between the lower edges is the more important factor and a gauging tool is desirable.

Siding boards are often made in lengths which require the services of two people to install. Provision of a tool to support one end of a board in its destined location on the wall enables one person to do the installation with relative ease.

Sliding boards are made also in different widths so it is desirable that the same tool should be adaptable to a range of board widths.

Several devices have been disclosed, namely U.S. Pat. Nos. 368,574; 4,208,799; 4,425,714; 4,473,100; 4,484,392; all of which use the top edge of the last previously installed board as a support for the respective device. Some boards may vary in width over their lengths and from board to board and any device using the top edge as a reference will automatically reflect this width variation in the distance between the lower edges of adjacent boards, which is undesirable. Also, all of these devices use some form of hook to provide the support and require that the board being installed must be left un-nailed over some of its length so that the device can be removed.

Other devices have been disclosed, namely U.S. Pat. Nos. 421,746; 445,681; 3,463,480; 3,518,770; 3,904,184; 4,158,455; in which some form of nail or spike has been used to support the device and the board being installed. The Mooney Pat. Nos. 421,746 and 445,681 show nut-and-bolt fasteners with separate awls to secure the devices to the building but in general these devices are relatively complicated to manufacture and to use.

Other devices have been disclosed, namely U.S. Pat. Nos. 325,811; 652,256; 774,114; in which nut-and-bolt type fasteners have been used to lock sliding members together.

It is the object of the present invention to provide a tool which is simple and inexpensive to manufacture and easy to use while ensuring maximum accuracy of installation with no damage to the siding material.

SUMMARY OF THE INVENTION

The object of the present invention is to provide a siding installation tool which will simply and inexpensively provide adjustment for spacing for a range of board widths and which can be used to support a board in its true location on the wall of the building and which can be removed easily after use without damage to the board.

The spacing adjustment is achieved by two elongated members which are in contact and constrained to slide relative to each other longitudinally. The inner member is the shorter and is provided with a flange which projects inwardly at the lower end. The outer and longer member is provided with a right-angled flange at its upper end, one leg of the right-angle projecting outwardly from the member, the other leg projecting upwardly and parallel to the member. The two slidable members are held together by a nut-and-bolt type fastener passing through a hole in the inner member and a longitudinal slot in the outer member, the head of the bolt being in contact with the inner member and the nut in contact with the outer member. The required board spacing is set by adjusting the distance between the upper faces of the inwardly projecting flange of the inner member and the outwardly projecting leg of the right-angled flange of the outer member. Tightening the nut-and-bolt fastener locks the two members at the required setting.

To achieve the support function of the tool the bolt section of the fastener is bored along its longitudinal axis to slidably accept a pin whose diameter is substantially the same as the nails used to install the siding boards. This pin is similar in shape to a common nail except that it has a thicker head. It is also made of hardened steel for durability. A bush made from a durable but resilient material such as urethane is secured to the bolt section of the fastener on a common longitudinal axis and the inner diameter of the bush is slightly less than the pin diameter. The pin is inserted into the fastener with its head facing outwardly. The pin is retained within the fastener by the gripping action of the resilient bush but it is still able to be moved axially.

In use, the two slidable members are adjusted to the required spacing as previously described and then the upper face of the flange on the inner slidable member is pressed upwardly against the lower edge of the last previously installed siding board. The pin is then driven inwardly to secure the tool to the side of the building. The next siding board may now be rested with its lower edge within the right-angled flange at the upper end of the outer slidable member thereby enabling the installer to move to another place along the board where another tool may be placed or nailing may start. When the board has been satisfactorily positioned and nailed the tool is removed by applying a force to the tool outwardly from the building. In most cases this force can be applied simply by pulling outwardly at the lowr end of the outer slidable member. If necessary the claw of a claw-foot hammer can be used to ease the tool away from the building. The hole left by the tool can now be filled by a regular siding nail. The tool, used singly or severally, will allow one person to install long siding boards with relative ease. It has the capability of being used as both a gauge and a support, separately or simultaneously.

These and other objects and advantages of the tool will become apparent from consideration of the following specification and accompanying drawings. It is to be understood that some features of the device are susceptible to change in design. Throughout the following descriptions like reference numerals refer to like parts.

DETAILED DESCRIPTION

Figure 1:
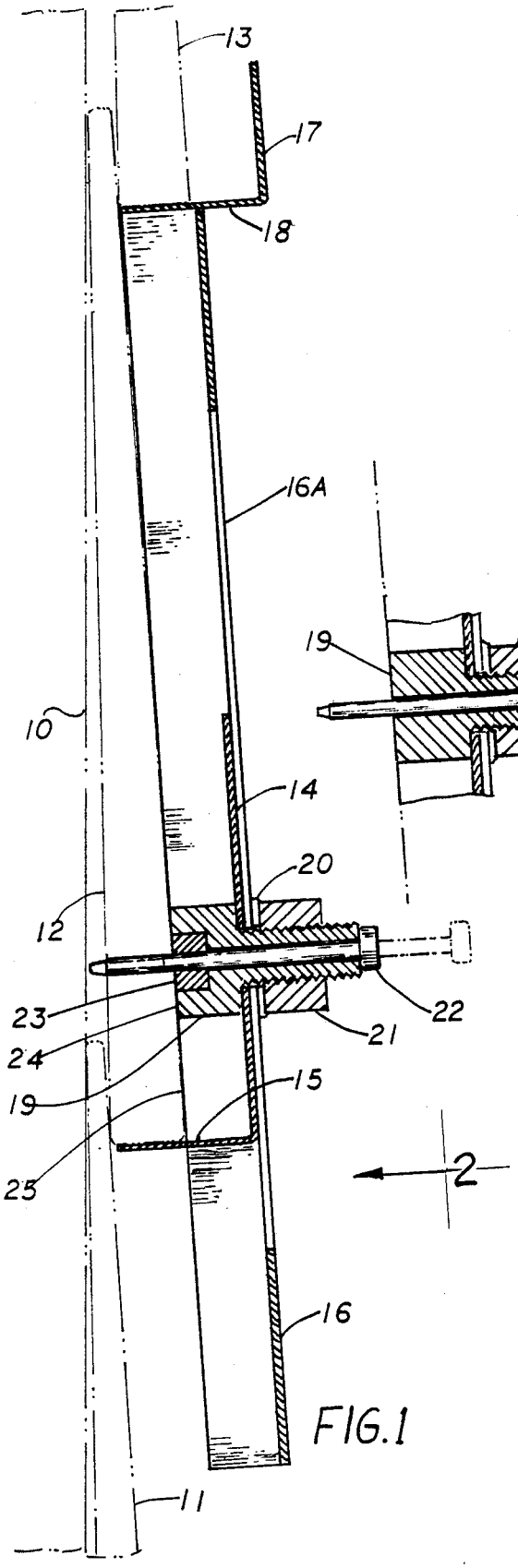
FIG. 1 is a sectional view of the tool as attached to the wall of a building. The section plane is on the vertical centre line and viewed from the left as indicated by line 1—1 in FIG. 2.

Referring to FIG. 1, phantom line 10 represents the vertical face of a building to which siding boards 11 and 12 have already been attached and board 13 is being positioned prior to attachment.

In accordance with the invention one or more tools may be used to position board 13 or similar item in the required location and one embodiment of such a tool is described as follows:

Member 14 is a flat metal plate approximately two inches wide and bent to form a ninety-degree angle with one leg approximately one inch long and the other leg approximately three inches long. The longer leg is drilled to accept a nut-and-bolt type fastener on its longitudinal axis at approximately one inch above face 15 of the shorter leg. The location of the fastener above face 15 is coincident with the location of the horizontal nailing line of the siding board being installed. Member 16 is made in the form of an elongated channel having two equal and parallel flanges which are approximately a half-inch wide and connected at ninety degrees to a web such that the distance between the flanges allows member 14 to slide easily within member 16 in a longitudinal direction without undue lateral movement. The length of member 16 is determined by the desired range of siding widths to be accomodated by the tool. The preferred embodiment as illustrated shows member 16 to be approximately nine inches long to accomodate siding boards with exposed spacing from three inches to eight-and-one-half inches. Adjustment over the spacing range is obtained by providing elongated slot 16A on the longitudinal axis of member 16, said slot having a width equal to the hole in member 14 and a length of approximately six inches extending upwardly from a point approximately one-and-one-half inches from the lower end of member 16. Member 16 is provided at its upper end with a right-angled flange having legs 17 and 18 each approximately one inch long, said flange being made integrally with member 16 or subsequently attached by welding or other manufacturing process, such that leg 18 is perpendicular to the plane of member 16 and leg 17 is parallel to member 16 and outward from the building.

The two members 14 and 16 are held together by bolt 19 and nut 21 with a preferred washer 20 between the said nut and the outer face of member 16. Bolt 19 is drilled along its longitudinal axis to slidably accept a pin 22 which is substantially of the same diameter as the nails which are normally used to attach siding boards to buildings. These nails are normally within the range 0.115 inch to 0.131 inch diameter and 2.0 inches to 2.5 inches long. The outward end of the pin is enlarged to provide a head approximately one-eighth of an inch thick and the inward end is tapered to facilitate penetration of the siding board material. The head of bolt 19 is bored on the longitudinal axis to accept a cylinder 23 of resilient material which is also bored on its longitudinal axis such that the hole diameter is slightly less than the diameter of pin 22. Cylinder 23 is approximately one-quarter of an inch long and its outside diameter is such that pressure is required to insert said cylinder into the head of bolt 19. The head of bolt 19 has a longitudinal dimension equal to the dimension between the inner face of member 14 and the plane 25 containing the inner edges of the flanges on member 16 such that when the tool is positioned and held in place on the board 12 the face 24 of bolt 19 is in contact with face of board 12.

Figure 3:
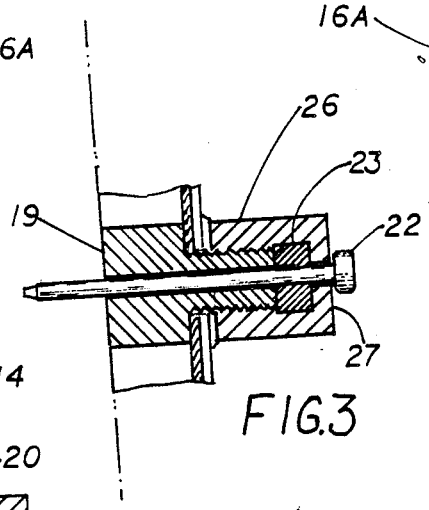
FIG. 3 is a sectional view of an alternative form of fastener.
Figure 2:
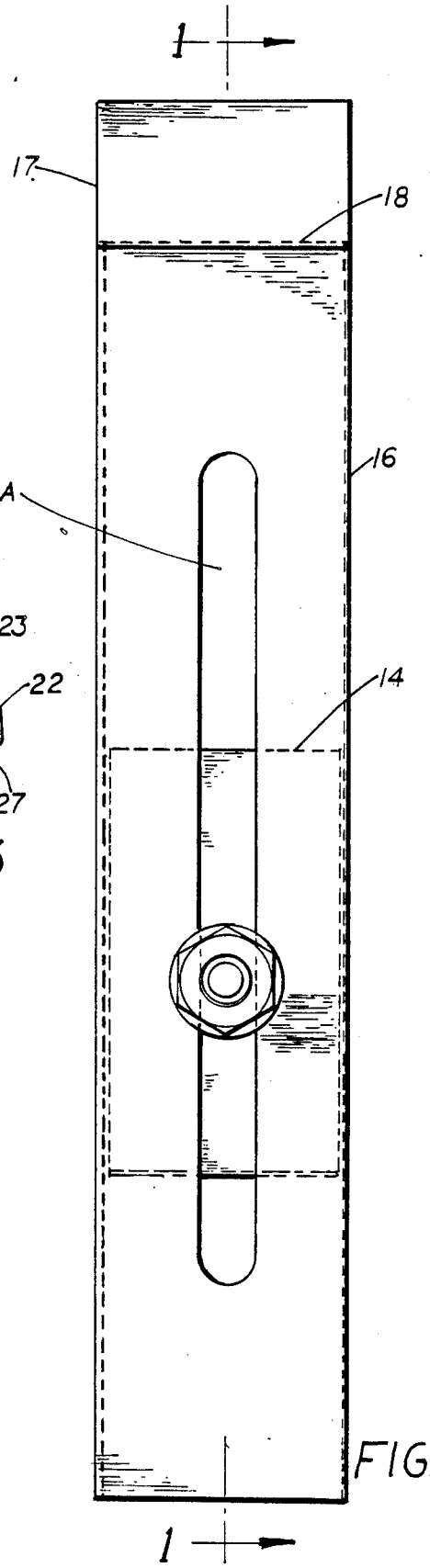
FIG. 2 is a front elevation viewed inwardly towards the building.

FIG. 3 shows an alternative arrangement of the fastener in which cylinder 23 is held on the longitudinal axis of bolt 19 by the nut 26 which has a closed end 27 and is sufficiently long to provide a space between 27 and the end of bolt 19 such that when nut 26 is in its tightened condition, cylinder 23 is securely retained within the fastener assembly.

From the foregoing description the operation of my invention is readily understood.

Horizontal siding boards are normally secured in place on the building from the lowermost board upwardly with a controlled exposed space between the lower edges of successive boards. In the use of my invention the lowermost board is first secured in position using normal methods of leveling and nailing. The described tool is now adjusted according to the desired amount of exposed siding surface by loosening nut 21 and setting the distance between the upper face 15 of member 14 and the upper face of 18 to be equal to the vertical dimension of the desired exposure. In this relative position of members 14 and 16 the nut 21 is re-tightened to provide adequate frictional engagement of members 14 and 16. With this setting established, the tool is now positioned with face 15 pressed upwardly against the lower edge of the aforesaid lowermost board so that the tool is upstanding. In setting the tool in this position the pin 22 is pushed or pulled outwardly so that its tapered end is now flush with face 24 of bolt 19. Pin 22 is held within the tool by the gripping action of the resilient cylinder 23. While the tool is held in this position the head of pin 22 is struck to cause penetration of its tapered end into the aforesaid attached board, thereby fastening the tool to the side of the building. The next board 13 may now be rested with its lower edge on the upper face of 18. In this condition one end of board 13 may be supported by the tool while the other end is nailed. Obviously, the use of a second tool would enable both ends to be supported. With board 13 fastened in place, the tool or tools can now be removed simply by applying an outward force to the lower end of member 16. The hole left by pin 22 can be filled by driving into it a regular siding nail.

Although I have disclosed the preferred embodiment of my invention, modifications and adaptations of the disclosed device are intended to be secured by these Letters Patent within the scope of the following claims:

I claim:

1. A tool for assisting in the installation of horizontal siding boards, comprising inner and outer upstanding slidable members held together by means of a nut-and-bolt type fastener, in which a bolt of said fastener is bored on its longitudinal axis to slidably accept a nail-like pin, the diameter of said pin being substantially the same as that of nails normally used in siding board installation, the length of said pin being greater than the overall length of said fastener, wherein the longitudinal axis of said bolt is coincident with a horizontal nailing line of a siding board being installed; a nut of said fastener having a closed end which is drilled to slidably accept said pin, said nut being sufficiently long to provide a space between said closed end and the end of the threaded portion of the bolt, when said nut is in a tightened condition on said bolt.

2. The invention of claim 1 in which said space is filled with a cylinder of resilient material, said cylinder having an inside diameter slightly less than the diameter of said nail-like pin so that when said nut is in its tightened condition said nail-like pin is slidably retained within said fastener.

* * * * *